United States Patent [19]

Lulich

[11] Patent Number: 4,875,551

[45] Date of Patent: Oct. 24, 1989

[54] PRE-LUBRICANT OIL PRESSURE ADAPTER

[75] Inventor: John F. Lulich, Pittsburgh, Pa.

[73] Assignee: R. P. M. Industries, Washington, Pa.

[21] Appl. No.: 108,161

[22] Filed: Oct. 13, 1987

[51] Int. Cl.[4] ..... F01M 11/03

[52] U.S. Cl. ..... 184/6.3; 184/6.24; 123/179 A; 123/196 S

[58] Field of Search ..... 184/6.3, 6.13, 6.24, 184/105.1, 6.4; 123/179 A, 179 B, 196 S

[56] References Cited

U.S. PATENT DOCUMENTS

| | | | |
|---|---|---|---|
| 1,379,259 | 5/1921 | Hans | 184/6.24 |
| 2,102,514 | 12/1937 | Clarkson | 184/6.3 |
| 2,110,662 | 3/1938 | Fisher | 184/6.3 |
| 2,143,533 | 1/1939 | Archea | 184/6.3 |
| 2,178,756 | 11/1939 | Joost | 123/196 S |
| 2,499,319 | 2/1950 | Lillquist | 123/196 S |
| 2,632,529 | 3/1953 | Kennedy | 184/6.3 |
| 2,725,954 | 12/1955 | Nallinger | 184/6.3 |
| 2,838,039 | 6/1958 | Smith | 184/6.3 |
| 2,928,499 | 3/1960 | Nallinger | 184/6.24 |
| 3,045,420 | 7/1962 | Addie | 184/6.4 |
| 3,057,436 | 10/1962 | Jacobson | 184/6.3 |
| 3,583,525 | 6/1971 | Holcomb | 123/196 S |
| 3,583,527 | 6/1971 | Raichel | 184/6 |
| 3,658,153 | 4/1972 | Berman | 184/6.3 |
| 3,722,623 | 3/1973 | Waldecker | 123/196 S |
| 3,917,027 | 11/1975 | Hakanson | 184/6.3 |
| 4,058,981 | 11/1977 | Henson | 184/6.3 |
| 4,061,204 | 12/1977 | Kautz | 123/196 S |
| 4,094,293 | 6/1978 | Evans | 123/196 S |
| 4,112,910 | 9/1978 | Percy | 184/6.3 |
| 4,126,997 | 11/1978 | Henson | 184/6.3 |
| 4,157,744 | 6/1979 | Capriotti | 184/6.3 |
| 4,174,699 | 11/1979 | Gill | 123/196 S |
| 4,199,950 | 4/1980 | Hakanson | 184/6.3 |
| 4,331,112 | 5/1982 | Pluequet | 184/6.3 |
| 4,421,078 | 12/1983 | Hurner | 123/196 S |
| 4,458,644 | 7/1984 | Papst | 184/6.3 |
| 4,462,350 | 7/1984 | Kurata | 123/196 S |
| 4,502,431 | 3/1985 | Lulich | 123/179 A |
| 4,512,298 | 4/1985 | Hayashi | 123/196 S |
| 4,628,877 | 12/1986 | Sundles | 123/196 S |

*Primary Examiner*—Leonard E. Smith

*Attorney, Agent, or Firm*—Reed Smith Shaw & McClay

[57] ABSTRACT

A pre-lubricant oil pressure adapter that enables oil and oil pressure to be supplied to an engine before it is engaged to crank. The adapter is comprised of an oil pump that is linked to an oil filter, and both of these are in turn linked to an oil system of an engine. Oil from the engine oil system is able to flow into the filter through the linkage, as well as oil from the oil pump. The oil cleaned by the filter passes from the filter back into the engine. When the engine is started, a delay switch allows the pump to operate but not the engine. The switch senses when the pressure is great enough in the engine and at that time allows the engine to engage. The pump is then disengaged. In another embodiment, the oil pump is disposed in the engine and is fluidically connected to an existing oil pump of an engine to provide oil pressure to the engine before it is engaged to crank.

10 Claims, 3 Drawing Sheets

PRE-LUBRICANT OIL PRESSURE ADAPTER

FIELD OF THE INVENTION

The present invention relates to a pre-lubricant oil filter adapter. More specifically, the present invention relates to an adaptor for an oil filter that allows oil pressure in an engine to be developed prior to engine cranking and ignition.

BACKGROUND OF THE INVENTION

Oil is used as a lubricant in engines to allow engine parts to slide freely and easily, with reduced friction. Notwithstanding the use of lubricants having high lubricity there continues to be some cutting and tearing between the metal in the internal engine components such as the turbocharger, the camshaft, the crankshaft, and the rocker assembly, to name a few. It has been known for some time that the greatest wear on internal engine component parts is during the initial moments during ignition cranking and engine start-up. At that time, the oil pressure in the engine has not built up sufficiently to provide oil to these parts. Consequently, for those first moments there can be essentially the bare metal rubbing against the bare metal. Over time, this is very detrimental to internal engine components.

One solution to this problem is to introduce chemical additives to the oil which cling to the walls of the cylinders after the engine is shut off. When the engine is next engaged, the cylinder walls have some lubricant present to protect them and the pistons from excessive wear and tear.

Another approach is a pre-lubrication system as disclosed in U.S. Pat. No. 4,502,431 to John F. Lulich. This patent discloses a novel system for introducing oil to the engine prior to cranking and start-up. This method has provided significant reduction in engine wear. However, the modifications required to the engine are applicable principally to large diesel engines.

A variety of additional approaches have been previously attempted to alleviate this problem, one such approach being exemplified by U.S. Pat. Nos. 3,583,525; 3,583,527; 3,722,623; 3,917,027; 4,061,204; 4,094,293; 4,112,910; 4,157,744 and 4,199,950. These patents generally teach that the problem relates to a lack of lubrication at start-up, and disclose systems having an auxiliary oil accumulator which through appropriate valving bleed off store a portion of the oil supply during normal engine operation and release it under pressure to the engine prior to or at the time of the next restart. While the release of a lesser quantity of oil from an auxiliary oil accumulator might yield some benefit, there would still remain a period during which the engine was cycling prior to the time that full lubrication was provided the moving parts. Because space is already at a premium in engine compartments, it is unacceptable to include an auxiliary oil accumulator having a sufficiently large volume, and even if it were practical, use of such a large volume accumulator would tend to create large variations in the oil supply of the engine. Finally, inclusion of a pressurized oil reservoir within a hot engine compartment presents an unacceptable safety hazard due to the possibility of a rupture and spray of flammable liquid thereover.

Another approach is exemplified by U.S. Pat. Nos. 4,058,981 and 4,126,997, which disclose that inadequate start-up lubrication is the cause of the problem and teach a valve system which initially routes engine oil to more critical engine components such as the turbocharger and crankshaft bearings upon start-up, and thereafter to less critical engine components. This approach is beneficial, but since it does not become operative until engine parts begin relative movement, premature wear of critical engine elements is still a problem.

Another approach, exemplified by U.S. Pat. No. 3,045,420 involves the use of a plurality of oil pumps, each supplying oil to separate engine lubrication systems. The pump which supplies oil to the turbocharger unit of the engine is actuated prior to combustion, continues during engine operation, and continues to operate for a brief period after engine shutdown to protect the relatively sensitive high speed turbocharger bearings. This system may be beneficial in extending the turbocharger life expectancy, but it does not protect other vital engine components, it introduces substantial complexity into the lubrication system of the engine, and failure of the turbocharger pump would lead to turbocharger failure within seconds.

Finally, manufacturers of internal combustion engines are known to attempt to minimize the problem by incorporating relatively large capacity oil pumps in the lubricating system in order to minimize the period between initial combustion and when engine oil pressure reaches its normal operating level. This approach has not had the desired result of reducing wear and it introduces unnecessary weight, size and expense to the engine assembly.

Accordingly, it is an object of the present invention to provide pre-compression/combustion protection to the parts of an internal combustion engine as well as during the first few moments of operation.

Another object of the present invention is to introduce via the oil filter mechanisms, a pump and linkage assembly that raises the oil pressure of an engine before it is allowed to crank to start.

SUMMARY OF THE INVENTION

These and other objects of the present invention are obtained with a pre-lubricant oil pressure apparatus comprising an oil filter, an oil pump and a linkage for linking the oil filter and the oil pump so oil pumped by the oil pump only goes into the oil filter. The linkage has at least a first opening to allow filtered oil to pass out of the oil filter and out the linkage, and at least a second opening to allow oil, not from the oil pump, to enter the oil filter to be cleaned. Also included in the apparatus is a means for starting the pump and means for delaying electricity to pass until the oil pump operates for at least a predetermined time or until a predetermined pressure is achieved. The delay means disengages the oil pump after the predetermined time or oil pressure level is reached and is electrically connected to the starting means. Additionally, there is a supply means for providing oil to the oil pump.

In an alternative embodiment, there is an oil pump means which includes an oil pump, an existing oil pump and an engine oil pump by-pass valve, all of which are disposed in the engine. The oil pump is fluidically connected to the engine oil pump by-pass valve which contacts the existing oil pump. Oil pumped by the oil pump passes into the existing oil pump through the engine oil by-pass valve, where it passes to the oil filter via existing internal engine channels. The oil by-pass valve in the existing oil pump must be modified to allow oil flow from the oil pump through the by-pass valve.

With regard to oil filters, there has not been much work done to adapt them in any way to somehow provide protection to internal engine parts during the first moments of operation. One example where a filter has been adapted with a linkage is found in the LUBE-MYND-R TM produced by Pall Performax filter products. This Pall product provides a linkage that connects the oil filter to the engine block via the customary O-ring assembly where oil filters normally attach to the engine block. The product is essentially an engine oil pressure monitor.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
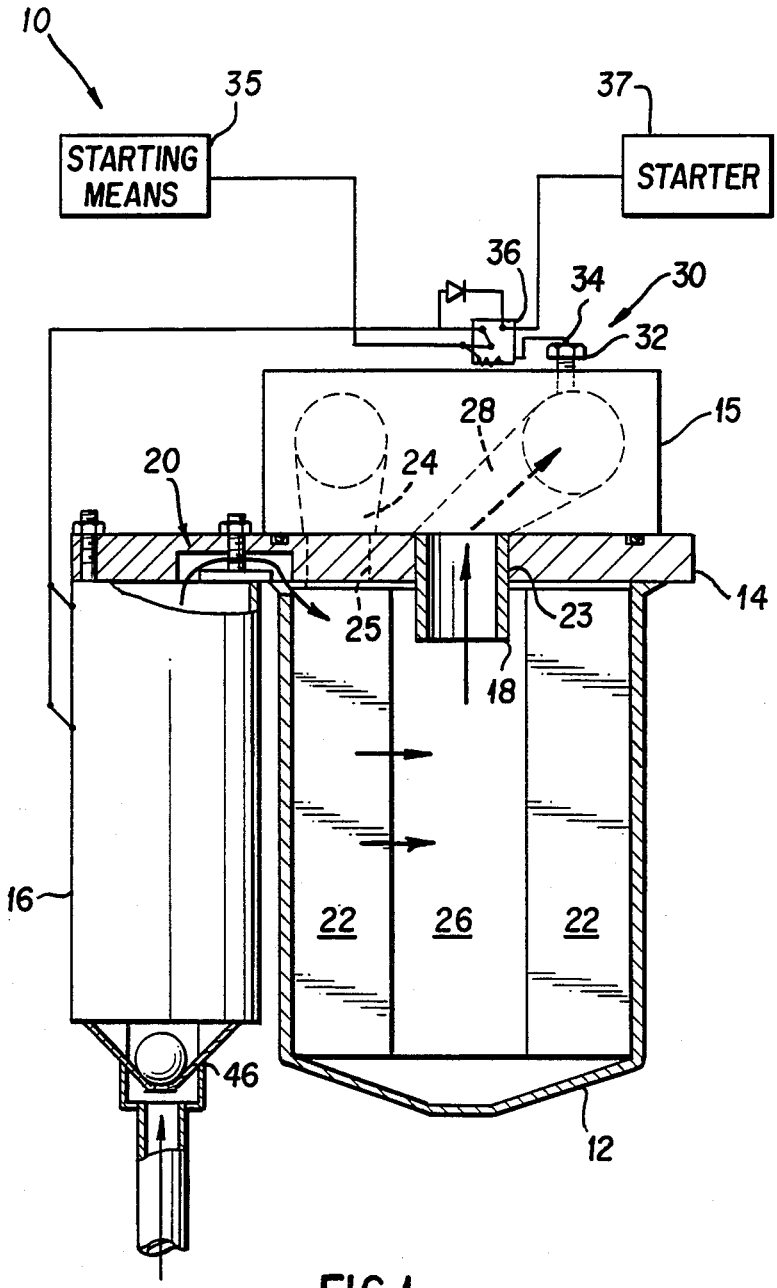
FIG. 1 is a side view of the external prelubricant oil pressure apparatus.
Figure 1:
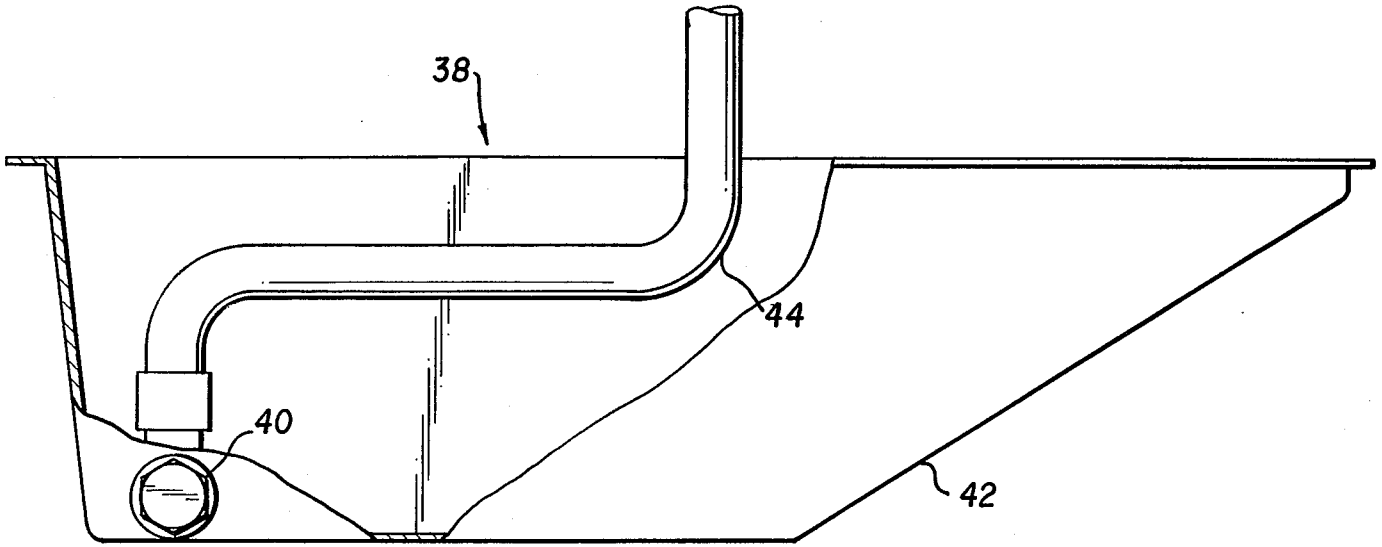

Referring now to the drawings, wherein like reference numerals designate identical or corresponding parts throughout the several views, and more particularly to FIG. 1 thereof, there is shown a pre-lubricant oil pressure apparatus 10. The apparatus 10 is comprised of an oil filter 12 mounted to a linkage 14 that also has a pump 16 and a first opening 23 and a second opening 25. The linkage 14 is attached to an engine block 15 (partially shown) through an O-ring assembly 18. The O-ring assembly 18 also extends through the linkage 14 where it is attached thereto and also attaches onto the oil filter 12 by way of the first opening 23. The oil pump 16 connects with the oil filter 12 through multiple linkage chambers 20 to pump oil into the filter 12. Oil from the engine 15 to be cleaned also passes by way of a first channel 24 into the oil filter 12 through the second opening 25 of the linkage 14. Oil cleaned by the filter 12 is received by the engine oil system via the O-ring assembly 18 and a second channel 28. A delay means 30 prevents the engine from starting when a starting means 35 is engaged until the oil pressure therein is raised sufficiently by the oil pump 16, but does allow the oil pump 16 to operate. A supply means 38 feeds oil to the oil pump 16 from the oil drain pan 42 via a hose 44.

More specifically, a filter 12 is attached to a linkage 14 that also connects to an oil pump 16. The filter 12 has all the traditional characteristics of a commonplace oil filter. The filter 12 is connected, with the linkage 14 to the engine through an O-ring assembly 18 that is typically found on an engine 15. The oil pump 16 is connected to the linkage 14 but is off to the side so it clears the engine 15. The oil pump 16 communicates with the filter 12 by way of multiple linkage chambers 20 so oil passes with sufficient capacity through the pump 16 into the filter 12. The filter 12 has a filter element 22 that circumferentially lines and fills the filter 12. The filter elements 22 traps metal shavings and other contaminants that have entered the oil during the operation of the engine. The unfiltered oil from the pump 16 and the existing engine oil pump (not shown) via the linkage chambers 20, and a first channel 24 and a second opening 25, respectively, enters the filter 12 in such a way that the unfiltered oil must pass through the filter element 22 in the filter. The forcing action of the oil through the filter element is from the pump 16 and the engine oil pump (not shown), once the engine begins to crank.

The cleansed oil passes from the filter element 22 into a hollow core 26 of the filter 12. The hollow core 26 communicates with the O-ring assembly 18 that penetrates the first opening 23 of the linkage 14 to allow the cleansed oil to pass out of the filter 12. The cleansed oil passes from the O-ring assembly 18 into the engine oil system (not shown) by way of a second channel 28.

A delay means 30 connects the second channel 28 of the engine oil system, the pump 16, a starter means 35, such as an ignition, and a starter 37 for the engine. The delay means 30 can, for example, be a simple moveable plug or plunger 32 that sealingly fits into the second chamber 28. When there is no pressure in the engine oil system and consequently no pressure in the second channel 28, a first switch 34 that senses the pressure in the engine oil system is open, preventing any electricity from passing through a second switch 36 to a starter. With the first switch 34 open, the starting switch only turns on the oil pump 16 causing unfiltered oil to be drawn through the oil pump 16 and passed into the filter. This, in turn raises the oil pressure of the entire engine oil system. When the oil pressure in the engine oil system and thus the second channel 28 is raised high enough by the pump 16, the plug 32 is pushed outward, causing the plug 32 to close the first switch 34. This causes the second switch 36 to allow the starter of the engine to engage and start the engine with little or no damage to the internal engine components since the already present oil pressure has caused oil to coat them.

A supply means 38 provides unfiltered oil to the oil pump 16 from the engine oil system. The supply mechanism 38 can be comprised of a 'tee' connection 40 that permits pre-lubrication pickup. The tee connection 40 connects oil drain pan 42 to a hose 44. The hose 44 is received by a check valve 46 of the oil pump 16. The check valve 46 operates to allow oil into the oil pump 16 through the hose 44 when the oil pump 16 is operating but prevents oil from leaving the oil pump 16 through the hose 44 when the oil pump 16 is off. The check valve also prevents oil from going backwards through the filter when the engine is running and has developed its own oil pressure.

Figure 2:
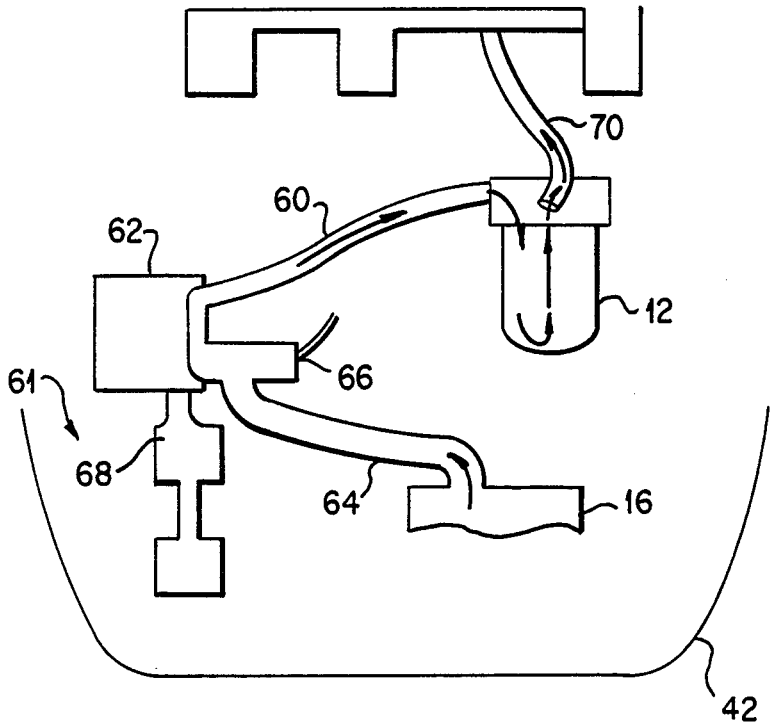
FIG. 2 is a side view of the internal prelubricant oil pressure apparatus.

The oil pump 16 can also be located internally to the engine, for instance, in an oil supply means such as the oil drain pan 42 as shown in FIG. 2. In such an embodiment the existing internal channels 60 to the oil filter 12 can be utilized. This is accomplished, for example, by a pump means 61 that preferably includes a pump 16, an existing oil pump 62 an engine oil draw 68 to draw oil up from the oil drain pan 42 to the oil pump 62 and an engine oil pump by-pass valve 66. The oil pump 16 is fluidically connected for example with a hose 64 to the engine oil pump by-pass valve 66 which is connected to and contacts the existing oil pump 62 in an engine. Oil is able to pass from the pump 16 into the existing oil pump 62 and communicate with the existing internal channels 60 that allow oil from the existing oil pump 62 to pass to the engine oil filter 12. The oil that passes into the engine oil pump by-pass valve 66 and then through the existing oil pump 62 to the existing internal channels 60 does not require the existing oil pump to be operating. For example, a check valve (not shown) in the engine oil bypass valve allows oil to pass into the existing oil pump 62 but does not allow oil to pass out of the existing oil pump 62 by way of the engine oil pump by-pass valve 66. The operation and structure of a typical existing oil pump 62 prevents the oil from the pump 16 which passes through the engine oil pump by-pass valve 66 into the existing oil pump 62 from flowing back into the oil pan 42 by way of the existing oil pump 62. The pump 16 and engine oil pump by-pass valve 66 can be designed to continue operation after the engine is engaged and the existing oil pump is operating or to cease operation at such time. The oil pump 16 can utilize the starting means 35 of an engine which is also electrically connected to a delay means 30. The delay means 30 is responsive to oil pressure. When the desired oil pressure is reached in the engine, the existing oil pump 62 is caused to start by the delay means 30. The delay means 30 can be similar to the delay means 30 described above. The filtered oil passes throughout the engine through existing internal supply channels 70.

Obviously, numerous (additional) modifications and variations of the present invention are possible in light of the above teachings. It is therefore to be understood that within the scope of the appended claims, the invention may be practiced otherwise than as specifically described herein.

I claim:

1. An apparatus for providing oil and oil pressure to an engine having an oil system before the engine engages comprising:

an oil filter;

an oil pump for pumping oil and raising the oil pressure in the engine;

a linkage having at least one linkage chamber for linking the oil filter and the oil pump so oil pumped by the oil pump is provided only to the oil filter via the linkage chamber which fluidically connects the oil pump and the oil filter, said linkage also linking the oil filter and the engine oil system at a first location, said linkage having at least a first opening and a second opening, said second opening allowing oil to pass from the engine oil system to the oil filter to be filtered;

an O-ring assembly that has a channel, said O-ring assembly being mounted in the engine and connecting the engine oil system at the first location with the linkage by way of the first opening so oil that has been filtered by the oil filter passes through the channel of the O-ring assembly into the engine oil system;

means for starting the pump and engine;

means for delaying the starting of the engine until there is oil pressure in the engine oil system, said delay means disengaging the pump after the engine engages, said delay means electrically connected to the starting means; and supply means for fluidically connecting the oil pump to the engine oil system at a second location.

2. An apparatus as described in claim 1 wherein the engine oil system at the first location has an engine oil system intake channel communicating with the O-ring and an outtake channel communicating with the second opening and wherein the oil filter includes a filter element circumferentially lining the filter and a hollow core, said oil filter being connected to the linkage through the O-ring assembly so oil from the outtake channel flows through the second opening of the linkage into the filter element and is cleaned, and oil cleaned by the filter element passes into the core and through the O-ring assembly into the intake channel of the engine oil system.

3. An apparatus as described in claim 2 wherein the oil pump is an electric oil pump having an inlet and an outlet, said outlet being connected to the linkage so oil that is pumped passes through the outlet into the linkage, said intake having a check valve disposed in it so oil can be drawn into the pump through the intake from the supply means but oil cannot flow back through the intake.

4. An apparatus as described in claim 3 wherein the linkage has at least one chamber that connects the pump with the oil filter so oil pumped by the pump flows through the chamber into the filter element of the oil filter.

5. An apparatus as described in claim 4 wherein the engine has an oil drain pan where oil in the engine oil system collects, and wherein the supply means is a tee connection between the oil drain pan and a hose that also connects to the check valve of the oil pump so oil can be drawn by the oil pump from the oil drain pan.

6. An apparatus as described in claim 5 wherein the delay means includes a plunger that is positioned in the engine oil system intake channel, and a switch, said switch being open and allowing electricity to pass only to the oil pump to operate only said oil pump when the oil pressure is below a desired oil pressure, but when the pressure in the intake channel is above the desired oil pressure and is great enough to push the plunger upwards, the switch is closed and electricity is allowed to pass only to the engine to actuate the engine, thus stopping the oil pump.

7. A pre-lubricant oil pressure apparatus comprising:

an oil filter;

an oil pump;

a linkage having at least one linkage chamber for linking the oil filter and the oil pump so oil pumped by the oil pump is provided only to the oil filter via the linkage chamber which fluidically connects the oil pump and the oil filter, said linkage having at least a first opening to allow filtered oil to pass out of the oil filter and out the linkage, and at least a second opening to allow additional oil to enter the oil filter to be cleaned;

means for starting the oil pump;

means for delaying electricity to pass to a starter of an engine until the oil pump operates for at least a predetermined time, said delay means disengaging the oil pump after the predetermined time, said delay means electrically connected to the starting means; and supply means for providing oil to the oil pump.

8. An apparatus as described in claim 7, wherein the pump is an electric oil pump having an inlet and an outlet, said outlet being connected to the linkage so oil that is pumped passes through the outlet into the linkage, said intake having a check valve disposed in it so oil can be drawn into the oil pump through the intake from the supply means but oil cannot flow back through the intake.

9. An apparatus as described in claim 8, wherein the linkage has at least one chamber that connects the oil pump with the oil filter so oil pumped by the oil pump flows through the chamber into the filter element of the oil filter.

10. An apparatus as described in claim 9, wherein the supply means is a tee connection between an oil source and a hose that also connects to the check valve of the oil pump so oil can be drawn by the pump from the oil source.

* * * * *